US005863279A

United States Patent [19]

Pouliot

[11] Patent Number: 5,863,279

[45] Date of Patent: Jan. 26, 1999

[54] MARTIAL ARTS APPARATUS FOR MOUNTING A BREAKING BOARD

[76] Inventor: Ronald Stephen Pouliot, 1140 Bramble Dr., Bollingbrook, Ill. 60440

[21] Appl. No.: 827,834

[22] Filed: Apr. 11, 1997

[51] Int. Cl.[6] ..... A63B 21/00

[52] U.S. Cl. ..... 482/83; 482/87; 264/70

[58] Field of Search ..... 269/69, 70, 71; 488/83–90

[56] References Cited

U.S. PATENT DOCUMENTS

| | | | |
|---|---|---|---|
| 2,576,660 | 11/1951 | Williams | 269/71 |
| 2,976,033 | 3/1961 | Martin | 269/70 |
| 3,427,021 | 2/1969 | Donato . | |
| 3,669,438 | 6/1972 | Pannell | 269/70 |
| 4,295,646 | 10/1981 | Squire . | |
| 4,403,772 | 9/1983 | Stangle . | |
| 4,491,316 | 1/1985 | Prince | 482/83 |
| 4,572,504 | 2/1986 | DiBartolo . | |
| 4,705,447 | 11/1987 | Smith | 264/71 |
| 4,787,625 | 11/1988 | Chaloux . | |
| 4,889,334 | 12/1989 | Partlo . | |
| 4,973,045 | 11/1990 | Heberer . | |
| 5,352,170 | 10/1994 | Condo et al. | 482/83 |
| 5,362,289 | 11/1994 | Holt . | |
| 5,415,371 | 5/1995 | Kirchner . | |
| 5,458,551 | 10/1995 | Shenton . | |
| 5,476,433 | 12/1995 | Bruner . | |

*Primary Examiner*—Jerome W. Donnelly
*Attorney, Agent, or Firm*—Speckman Pauley Petersen & Fejer

[57] ABSTRACT

A martial arts apparatus for mounting a breaking board with respect to a ground surface or another suitable structural member. A backing frame is adjustably mounted with respect to the structural support member. A back plate is adjustably mounted with respect to the backing frame. A front plate is adjustably mounted to rotate with respect to the back plate. A pair of arms are each pivotally attached with respect to the front plate. Each arm preferably has a front portion pivotally attached with respect to a rear portion. A plurality of clamping members mechanically cooperate with the front portions of the arms to clamp the breaking board between the clamping members and the front portions of the arms. The martial arts apparatus according to this invention is capable of rotating a breaking board within a plane, and rotating the breaking board into and out of a plane established by the breaking board which can be generally vertical with respect to a ground surface.

17 Claims, 8 Drawing Sheets

MARTIAL ARTS APPARATUS FOR MOUNTING A BREAKING BOARD

BACKGROUND OF THE INVENTION

1. Field of the Invention

This invention relates to a holding apparatus for releasably mounting a breaking board which is often used in martial arts training and competition.

2. Description of Prior Art

U.S. Pat. No. 5,476,433 discloses a board holder station for a martial arts training apparatus. The board can be rotated into and out of a normal position within a vertical plane, which is generally perpendicular to a ground surface.

U.S. Pat. No. 4,491,316 discloses an apparatus for mounting a breaking board. The breaking board can be rotated within a vertical plane that is generally perpendicular to a ground surface. The board can also be rotated into and out of the vertical plane, in order to change the angular position of the board with respect to the ground surface.

U.S. Pat. No. 4,889,334 discloses a frame for securing a kicking board. When the kicking board is broken, upper frame members and a cross-piece swing upward and away from the kicking board.

U.S. Pat. No. 4,787,625 discloses a holding apparatus that has a pair of jaws for mounting a board. The jaws have removable, adjustable stop plates for holding the boards. The jaws can be rotated into different angular positions.

It is apparent from the teachings of the prior art that there is need for a mounting apparatus that can be easily adjusted without the need for tools and that offers structural stability, safeguards against user injury and reliability.

SUMMARY OF THE INVENTION

It is one object of this invention to provide a martial arts apparatus for adjustably mounting a breaking board, wherein a position of the breaking board can be adjusted in height, rotated within a plane, and rotated into and out of a vertical plane which is generally perpendicular to a ground surface.

It is another object of this invention to provide a martial arts apparatus having arms, used to hold a breaking board, that pivot away from each other when an impact force is applied to and breaks or fractures the breaking board.

The above and other objects of this invention are accomplished with an apparatus having a backing frame adjustably mounted with respect to a structural support member, such as an upright member, a base, a wall, a floor or another suitable structural component. A position of the backing frame can be adjusted with respect to a ground surface, or with respect to the structural support member. A back plate is adjustably mounted, preferably to slide with respect to the backing frame, so that the back plate can be adjusted between different positions along a longitudinal direction of the backing frame.

In one preferred embodiment according to this invention, a front plate is adjustably mounted to rotate with respect to the back plate. The front plate is preferably but not necessarily positioned generally parallel to the back plate.

A pair of arms are pivotally attached with respect to the front plate, such as with hinges. When the breaking board is broken, an impact force applied to the breaking board is transferred to and thereby separates the arms away from each other, which provides a safeguard for the user.

Each arm has a front portion which is pivotally mounted with respect to a rear portion. Each arm also cooperates with a clamping member that is mechanically operated to clamp the breaking board between the clamping member and a surface of the front portion of the arm.

With the martial arts apparatus according to this invention, a position of the breaking board can be rotated within one plane, can be adjusted in height with respect to the ground surface, and can be rotated into and out of a particular plane so that the angular position of the breaking board with respect to the ground surface can be adjusted. Because the martial arts apparatus of this invention has a substantial frame assembly the framework remains sturdy and intact even when an impact force, such as one delivered by a martial arts technique, is applied to the breaking board.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
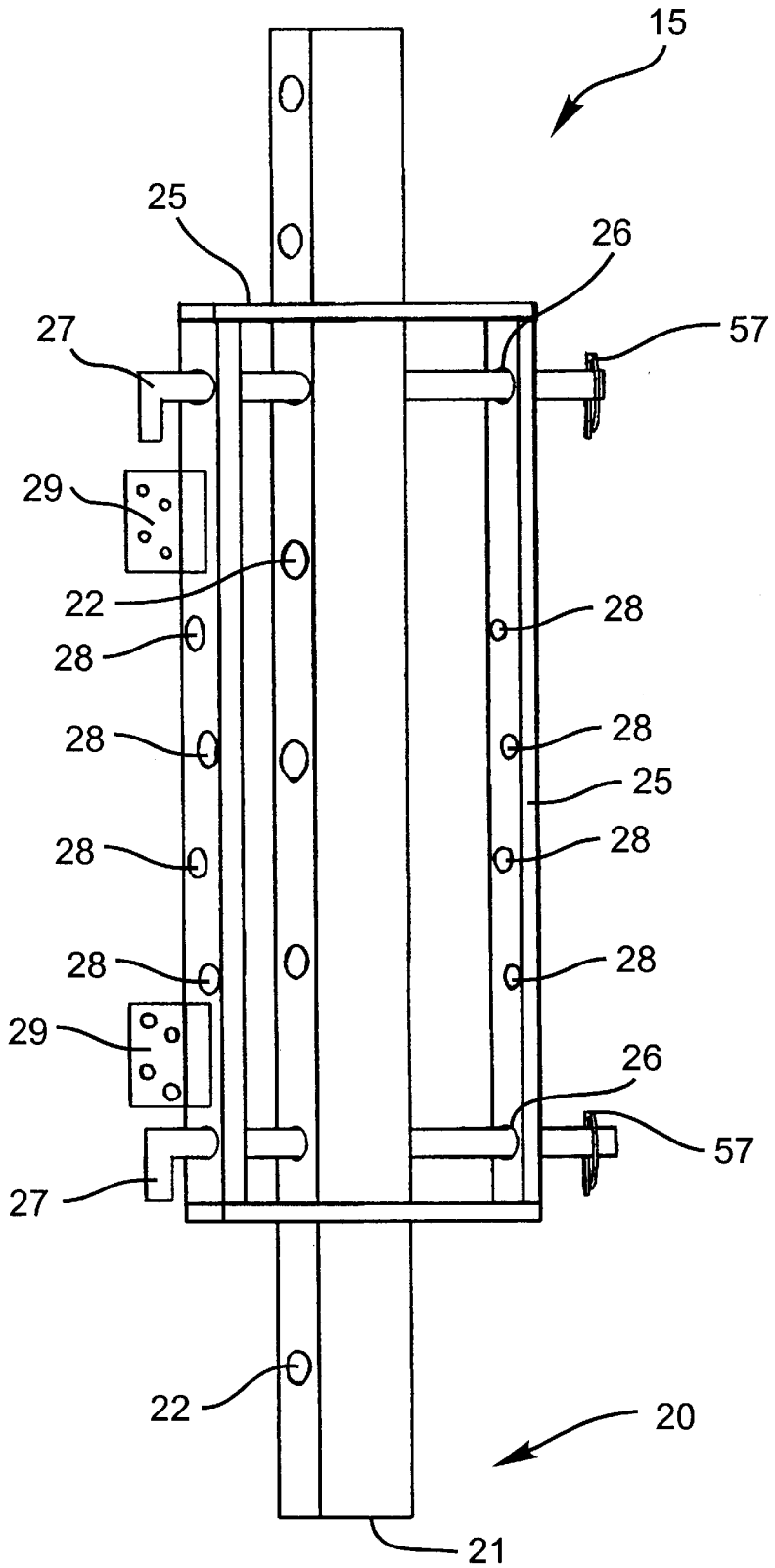
FIG. 1 is a perspective view of a backing frame releasably mounted with respect to a structural support member, according to one preferred embodiment of this invention.
Figure 4:
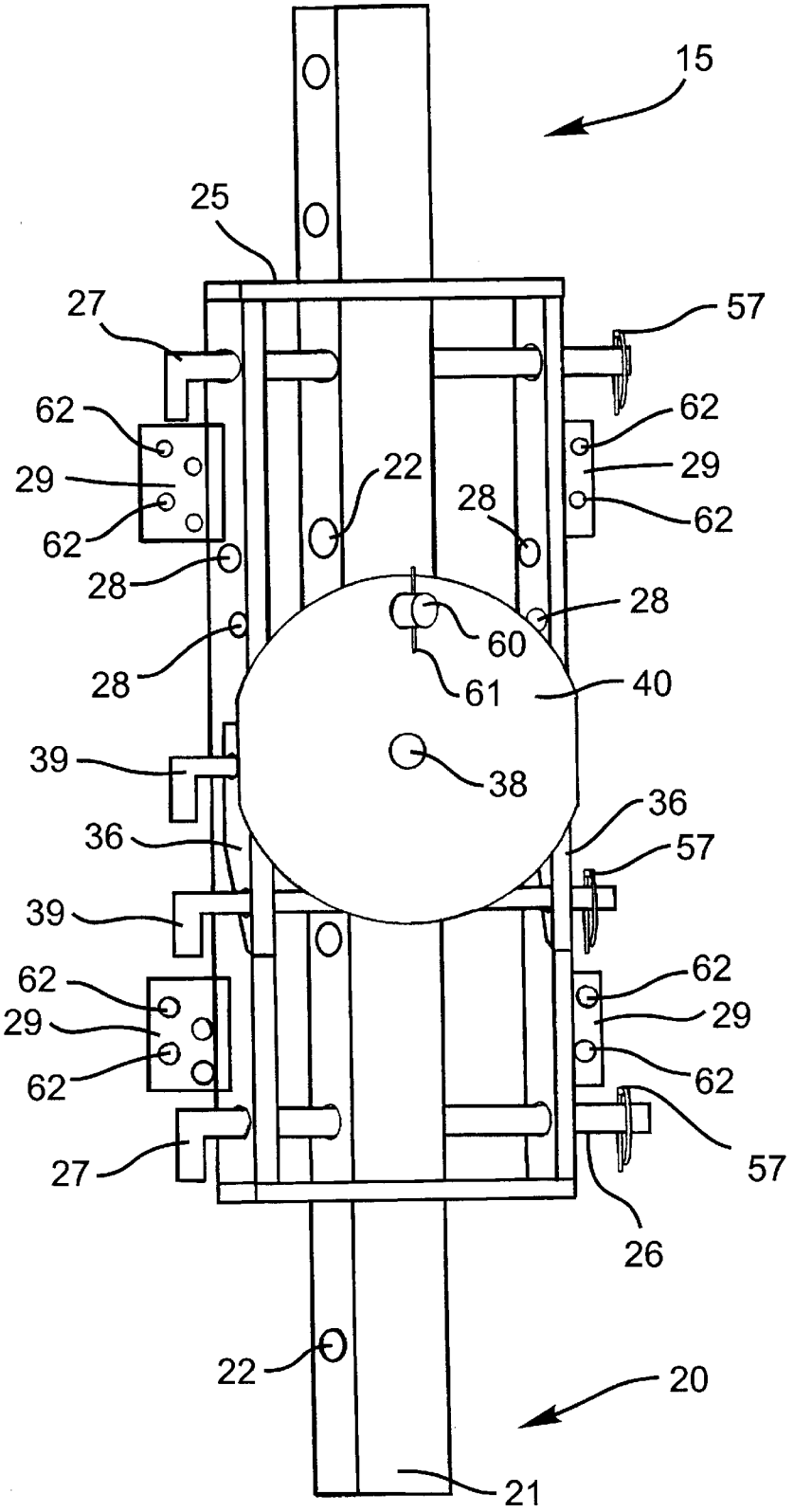
FIG. 4 is a perspective view of a front plate rotatably mounted with respect to a back plate which is slidably mounted with respect to a backing frame and a structural support member, according to one preferred embodiment of this invention.

FIG. 1 shows a partially assembled martial arts apparatus 15 according to one preferred embodiment of this invention, which in combination with other elements is used to hold or mount a breaking board with respect to structural support member 20. As shown in FIG. 1, structural support member 20 comprises upright member 21. However, it is apparent that structural support member 20 may also comprise a wall, a ground surface, a floor, a suspended framework, or any other suitable structural member that offers adequate structural support to backing frame 25. Bracket 29 having one or more bracket mount holes 62, as shown in FIG. 4, can be used to mount backing frame 25 to a wall, for example.

In one preferred embodiment of this invention, upright member 21 is secured to a base, such as a triangular-shaped base which can be constructed of wood, metal, plastic or any other suitable material or composite material. For example, a lower portion of upright member 21 can be mounted in a corner area of a triangular-shaped base. The triangular shape offers enhanced structural support for resisting an impact force when applied to the breaking board. The base can also can be formed by a wall, a ground surface or can be constructed of any other suitable element constructed of a shape and/or material that adequately resists the impact force.

Figure 3:
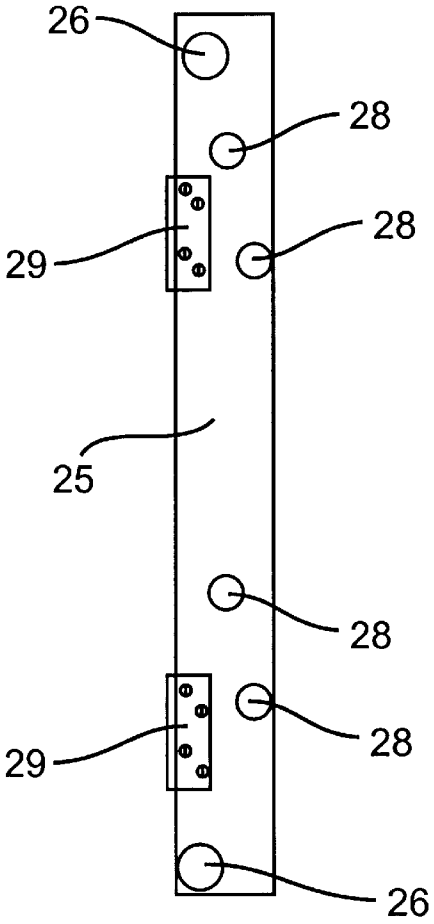
FIG. 3 is a side view of the backing frame, as shown in FIG. 2.
Figure 2:
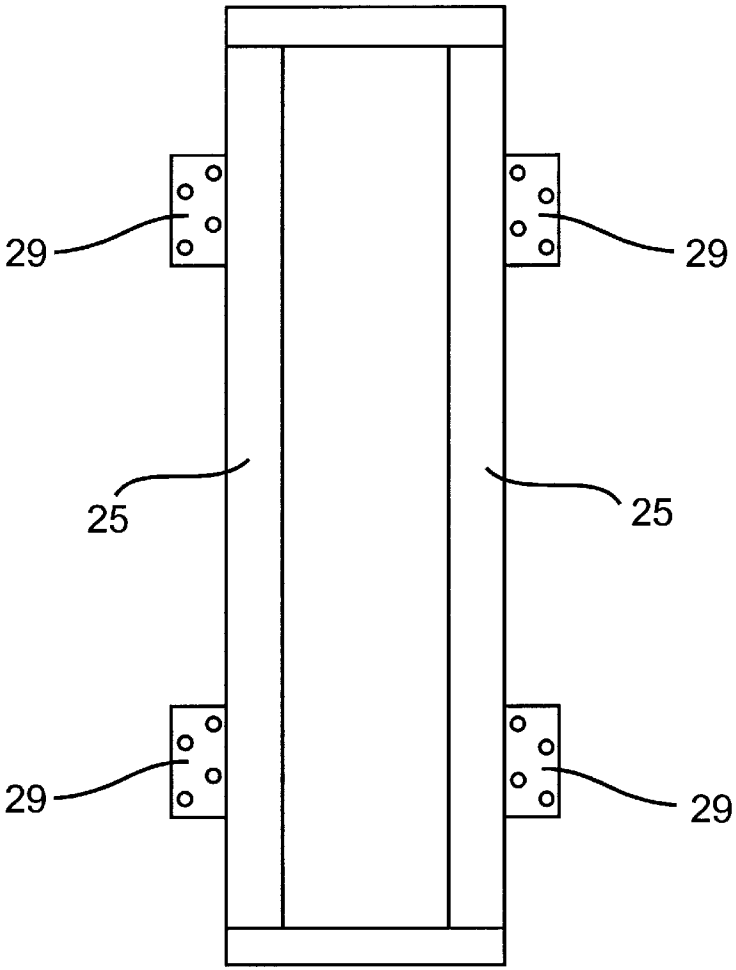
FIG. 2 is a front view of a backing frame, according to one preferred embodiment of this invention.

In one preferred embodiment of this invention, upright member 21 has a plurality of holes 22 which can be used to adjust the position of backing frame 25 with respect to structural support member 20, or upright member 21. As shown in FIGS. 1, 3 and 4, backing frame 25 comprises a plurality of holes 26. As shown in FIGS. 1 and 4, pin 27 can be mounted within hole 22 and hole 26 to fix the position of backing frame 25 with respect to structural support member 20. By removing pin 27 and adjusting the position of backing frame 25 with respect to structural support member 20, a different hole 22 can be aligned with hole 26 and pin 27 can be mounted within the different hole 22 and hole 26 to fix backing frame 25 in a different position with respect to structural support member 20. Pin 27 can be retained in a mounted position by inserting hitch pin clip 57 through a hole within pin 27, such as shown in FIG. 1.

Figure 7:
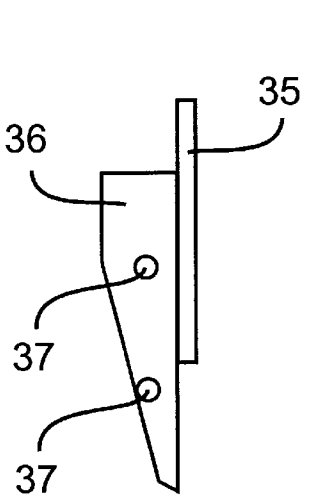
FIG. 7 is a side view of the back plate, as shown in FIGS. 5 and 6.
Figure 6:
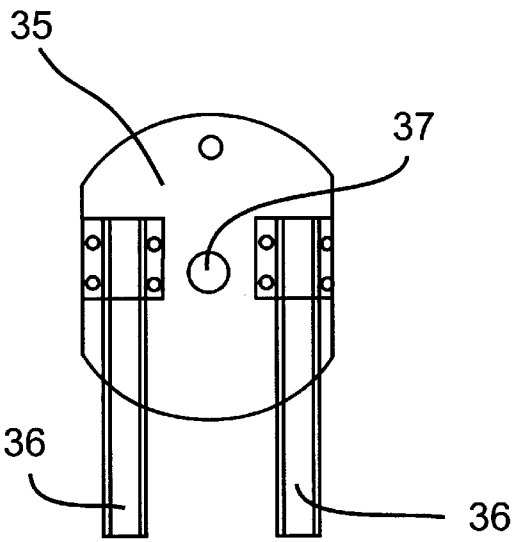
FIG. 6 is a rear view of the back plate, as shown in FIG. 5.
Figure 5:
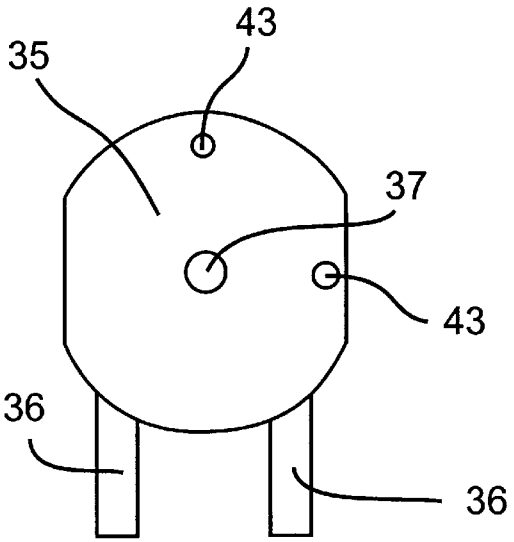
FIG. 5 is a front view of a back plate, according to one preferred embodiment of this invention.

Back plate 35, such as shown in FIGS. 5–7, is adjustably mounted with respect to backing frame 25, according to one preferred embodiment of this invention. As shown in FIG. 4, holes 37 of mounting bracket 36 are aligned with corresponding holes 28 and pin 39 is mounted within holes 28 and 37 to fix the position of back plate 35 with respect to backing frame 25. The spacing of holes 28 and holes 37 can be used to accomplish finer adjustment of the position of back plate 35, for example with respect to the ground surface, than the adjustment achieved by moving backing frame 25 with respect to upright member 21.

Although not shown in the drawings, it is apparent that other devices can be used to adjust the position of backing frame 25 with respect to structural support member 20, upright member 21 and/or back plate 35. However, pins 27 and 39 and accommodating holes 22, 26, 28 and 37 allow for convenient adjustment means without the need for special tools. In lieu of using holes 28 and 37 to adjust mounting bracket 36 with respect to backing frame 25, it is apparent that other rails, channels or other suitable elements and/or mechanical devices can be used to allow mounting bracket 36 to slide or be repositioned with respect to backing frame 25.

As shown in FIGS. 4 and 10–12, front plate 40 is adjustably mounted to rotate with respect to back plate 35. Front plate 40 is preferably but not necessarily positioned approximately parallel to back plate 35. Back plate 35 and/or front plate 40 can have a rectangular shape as shown in FIG. 4, a generally rounded or circular shape as shown in FIGS. 5–12, or any other suitable shape that allows front plate 40 to rotate with respect to back plate 35.

In one preferred embodiment of this invention, rod 38 is secured with respect to back plate 35 and front plate 40 comprises hole 41, preferably but not necessarily centrally located on front plate 40. In one preferred embodiment, rod 38 comprises an externally threaded bolt which accepts a nut that can be tightened to fix the position of front plate 40 with respect to back plate 35, once the rotational position is adjusted. It is apparent that other mechanical devices suitable for rotatably mounting one plate with respect to another plate can be used in lieu of rod 38 and/or hole 41.

Figure 10:
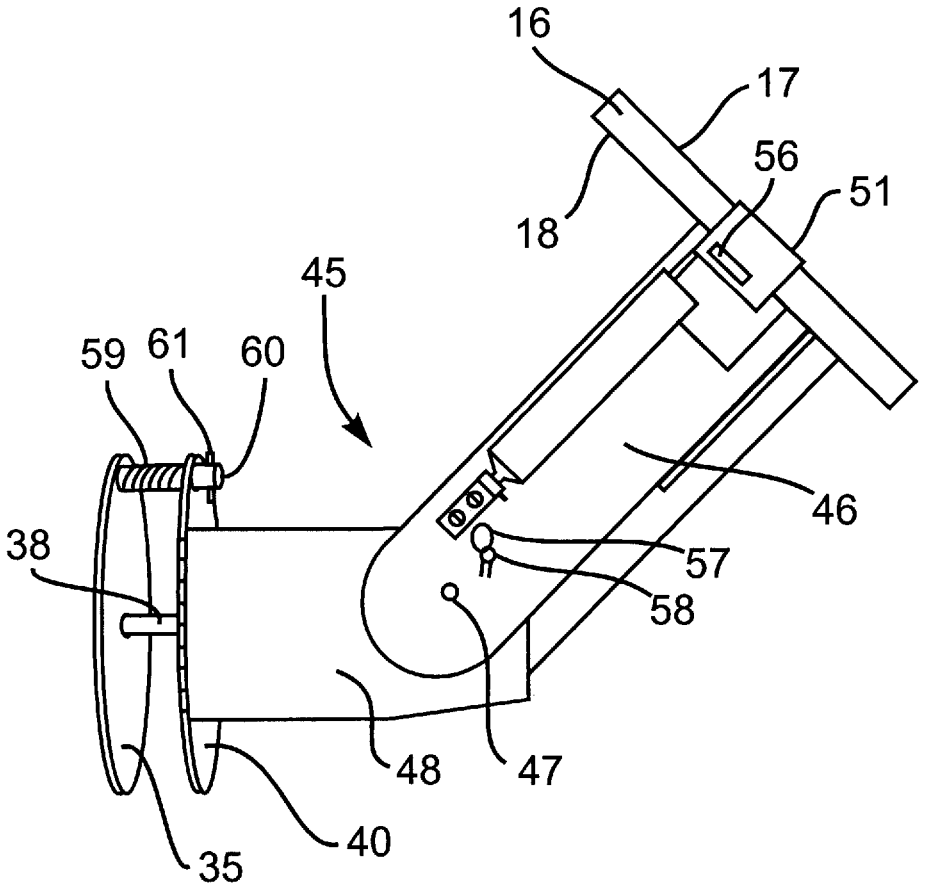
FIG. 10 is a perspective view of a front plate rotatably mounted with respect to a back plate, two arms pivotally mounted with respect to the front plate and one breaking board positioned between the arms and clamping members, according to one preferred embodiment of this invention.
Figure 11:
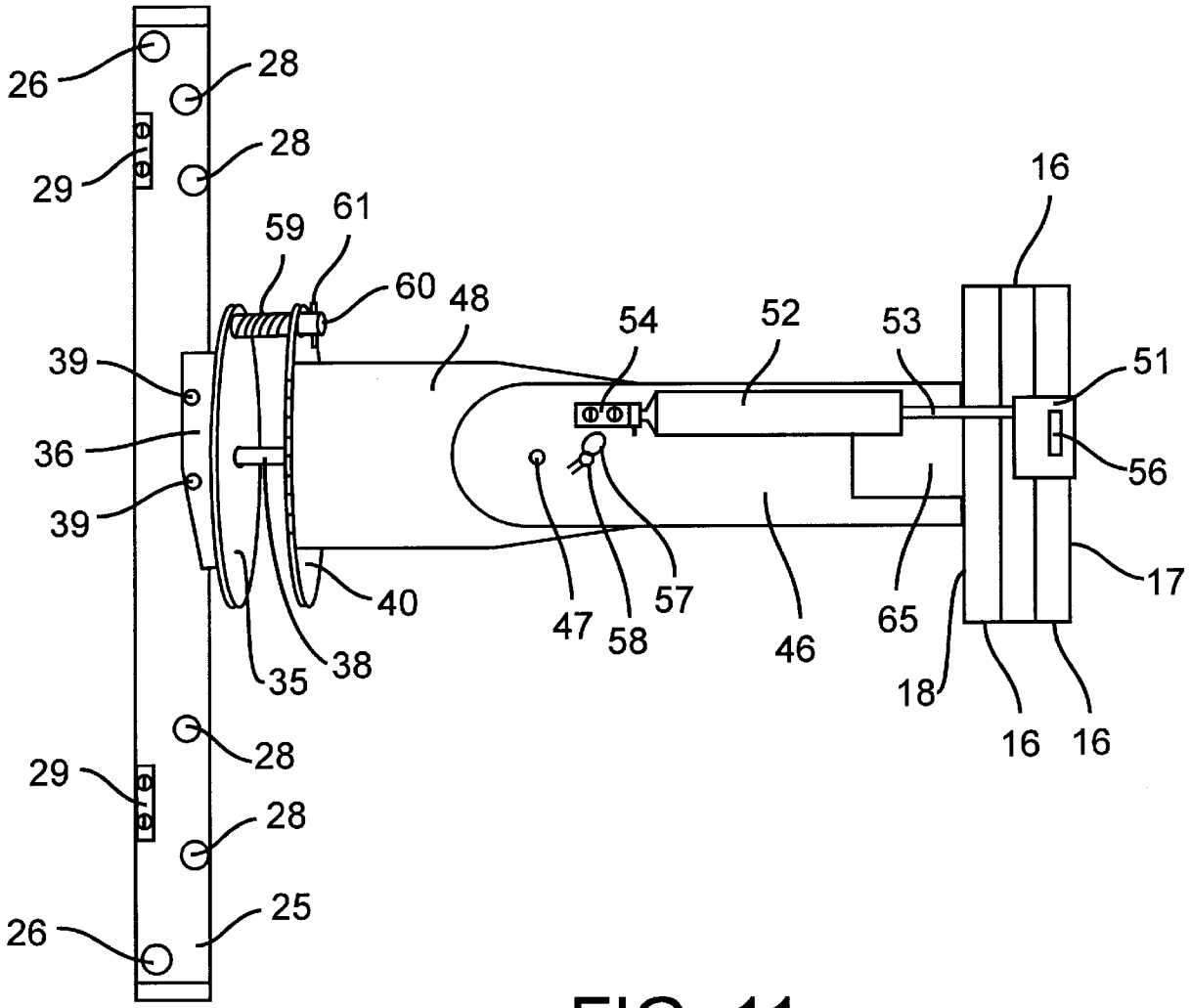
FIG. 11 is a partial perspective, partial side view of a mounting apparatus with arms mounted to pivot in a general horizontal plane, according to one preferred embodiment of this invention.

Once rotated into a desired position, means for fixing front plate 40 with respect to back plate 35 may comprise the externally threaded bolt and nut combination or a spring-loaded pin positioned within a corresponding hole of back plate 35, as later discussed. It is apparent that more holes can be positioned about a periphery of back plate 35 for accommodating more positions of front plate 40 with respect to back plate 35. It is also apparent that the means for fixing the position of front plate 40 with respect to back plate 35 may comprise a clamp, interfering elements or any other similar and suitable mechanical device known to those skilled in the art. For example, as shown in FIGS. 10 and 11, the means for fixing may comprise pivot locking pin 60 extending through aligned holes within back plate 35 and front plate 40. Tension spring 59 can be used to urge pivot locking pin 60 into both holes, in a normal condition. Finger grip rod 61 can be used to accommodate a pulling force applied to pivot locking pin 60.

Figure 8:
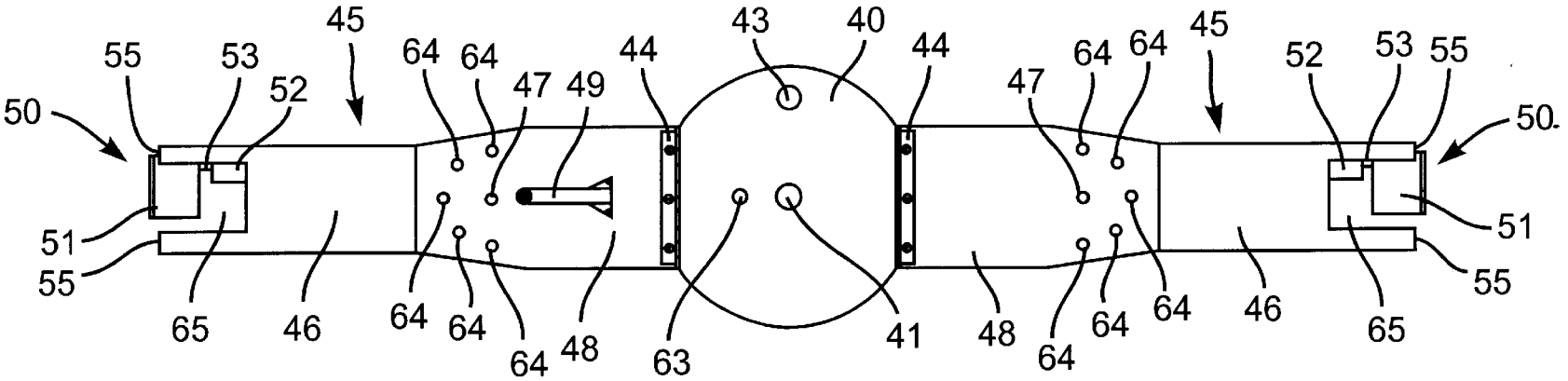
FIG. 8 is a front view of two arms pivotally attached with respect to a front plate, according to one preferred embodiment of this invention.
Figure 9:
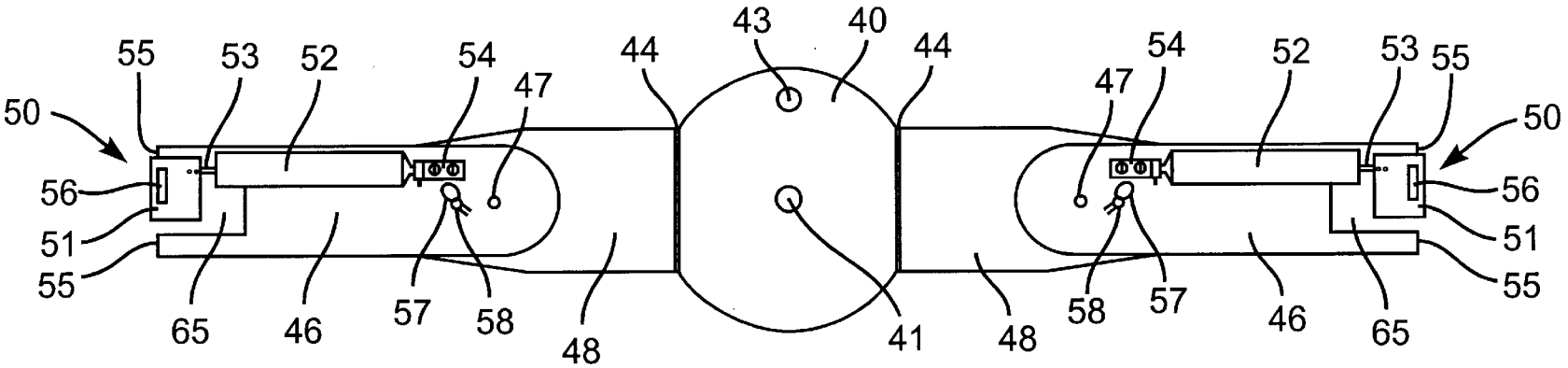
FIG. 9 is a rear view of the two arms pivotally attached to the front plate, as shown in FIG. 8.
Figure 12:
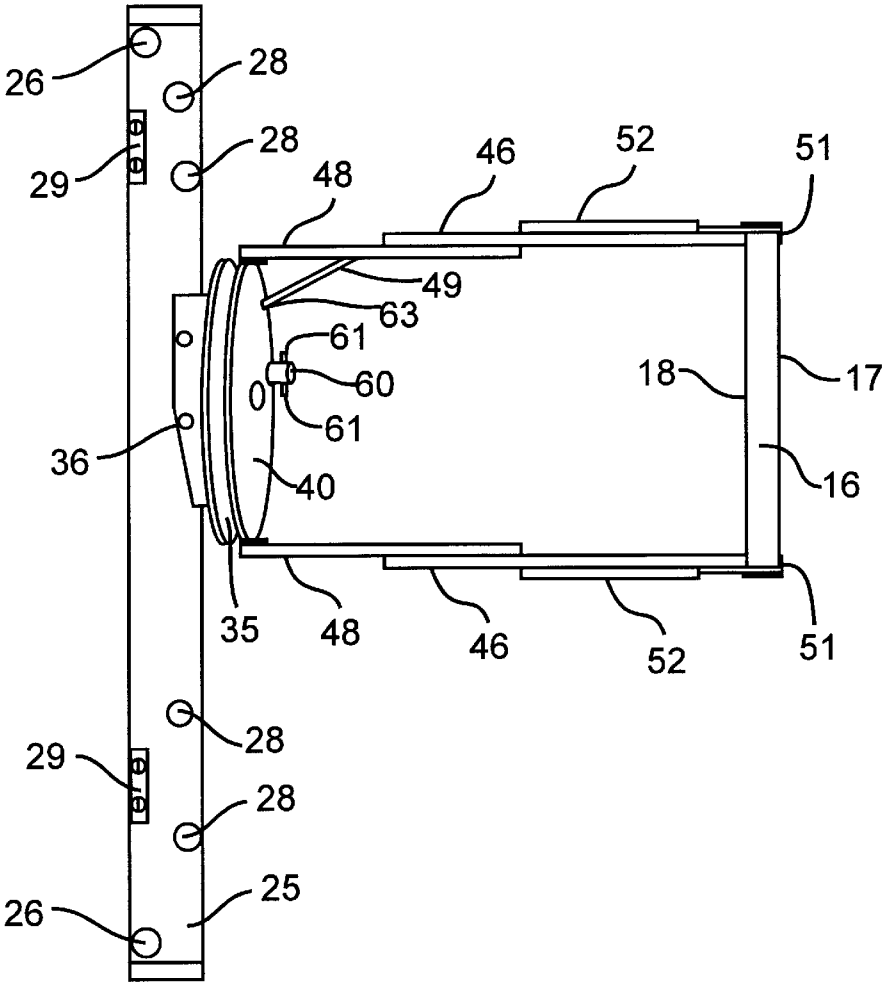
FIG. 12 is a partial perspective, partial side view of the mounting apparatus shown in FIG. 11 but with the front plate rotated 90° with respect to the back plate.

As shown in FIGS. 8 and 9, a pair of arms 45 are each pivotally attached with respect to front plate 40. In one preferred embodiment according to this invention, arm 45 is attached to hinge 44 which is attached to front plate 40. However, it is apparent that any other suitable direct or indirect pivotal connection can be used to allow arm 45 to pivot with respect to front plate 40. In a mounted position of breaking board 16, as shown in FIGS. 10–12, clamping members 50 are fixed with respect to breaking board 16 and thus both arms 45 are fixed with respect to each other. When the impact force is applied sufficient to break or fracture breaking board 16, the impact force is transferred through breaking board 16 and thereby urges arms 45 apart from each other. To avoid user injury, stop element 49 can be used to limit movement of arms 45 with respect to each other; for example, as shown in FIG. 12, stop element 49 may comprise a conventional door stop bracket or another similar and suitable bracket. As shown in FIG. 8, front plate 40 may comprise pivoting stop element extraction 63 aligned with stop element 49, so that movement of arm 45 with respect to front plate 40 is limited, which is particularly important, from a safety standpoint, when arms 45 pivot in a general vertical plane. In another preferred embodiment according to this invention, a spring, a band or another member that supplies a bias force can be used to normally urge arms 45 apart from each other. When breaking board 16 is broken, from a safety standpoint it is advantageous for arms 45 to move away from each other in order to keep arms 45 and clamping members 50 away from hands and/or feet of the user.

Arms 45 preferably pivot within a first plane. Depending upon the rotational position of front plate 40 with respect to back plate 35, the first plane can be positioned horizontally, vertically, or at any other suitable angle with respect to the ground surface. With a preferred embodiment comprising a combination of back plate 35, rod 38, front plate 40 and hole 41, there is an infinite number of rotational positions into which front plate 40 can be adjusted with respect to back plate 35. Because a relatively small torsional force is applied to front plate 40, an externally threaded bolt and nut arrangement can be sufficient to retain the position of front plate 40 with respect to back plate 35, when applying the impact force. However, pivot locking pin 60 and the corresponding hole combination previously discussed can provide better structural support.

In one preferred embodiment according to this invention, arms 45 can also pivot to move breaking board 16 into and out of the generally vertical plane, as shown between FIGS. 10 and 11, so that the angle of breaking board 16 with respect to the ground surface can be adjusted. In another preferred embodiment of this invention which is not shown in the drawings, such pivoting movement can also be accomplished by pivotally, in addition to or in lieu of rotatably, mounting front plate 40 with respect to back plate 35. In one preferred embodiment, each arm 45 comprises front portion 46 and rear portion 48 wherein front portion 46 pivots with respect to rear portion 48. As shown in FIGS. 8–11, pin 47 is used to allow front portion 46 to pivot with respect to rear portion 48. As shown in FIGS. 8–11, according to one preferred embodiment, hitch pin 58 can be mounted within degree pivot hole 64 to fix the angular position of front portion 46 with respect to rear portion 48. Hitch pin clip 57 can be used to retain hitch pin 58 in a mounted position. It is apparent that a hinge, a gear or any other suitable mechanical device can be used as means for allowing front portion 46 to pivot with respect to rear portion 48.

The combination of relative rotational adjustment between front plate 40 and back plate 35 as well as pivotal adjustment between front portion 46 and rear portion 48 allows breaking board 16 to be rotated within a general plane established by breaking board 16, as well as rotated into and out of a generally vertical position with respect to the ground surface. Front portion 46 and rear portion 48 pivot within a second plane that is generally perpendicular to the first plane, in one preferred embodiment. As used throughout this specification and in the claims, the phrase pivot within a plane is intended to relate to a general plane defined by movement of the particular element or elements, for example even if both elements, such as arms 45, do not move precisely within the same exact plane.

A plurality of clamping members 50 each mechanically cooperate with a corresponding front portion 46, to clamp breaking board 16 preferably between clamping member 50 and front portion 46. As shown in FIGS. 9–11, clamping member 50 may comprise protruding finger grip 56 that a user can grip to pull or extend hydraulic cylinder 52 and thus clamping member 50 away from front portion 46, when loading one or more breaking boards 16. In one preferred embodiment according to this invention, front portion 46 has at least two contact surfaces, such as forearm ends 55 as shown in FIGS. 8 and 9, separated at a sufficient distance from each other to provide adequate contact with and thus support to face 18 of breaking board 16, as shown in FIGS. 10 and 11. As shown in FIGS. 8 and 9, front portion 46 of arm 45 may form a void or space 65 into which breaking board 16 can move when broken.

As shown in FIGS. 10–12, clamping member 50 comprises angle bracket 51. It is apparent that clamping member 50 may also comprise mechanical fingers, a flange, a shoulder or any other suitable structure that provides a sufficient contact surface or holding structure for breaking board 16. In a clamped position of breaking board 16, each clamping member 50 preferably but not necessarily contacts face 17 of breaking board 16. In the clamped position, clamping member 50 is preferably urged toward front portion 46 of arm 45. Means for clamping breaking board 16 between clamping members 50 and front portions 46 may comprise a plurality of hydraulic cylinders 52 each having end portion 53 attached with respect to clamping member 50 and end portion 54 attached with respect to a corresponding front portion 46. In one preferred embodiment, end portion 53 comprises a hydraulic rod and end portion 54 comprises a mounting bracket for hydraulic cylinder 52, as shown in FIGS. 9 and 11. It is apparent that end portion 53 and/or end portion 54 may comprise any other mechanical element suitable for securing hydraulic cylinder 52 with respect to front portion 46 of arm 45 and clamping member 50. Hydraulic cylinder 52 preferably applies a tension force that draws clamping member 50 toward front portion 46. It is apparent that hydraulic cylinder 52 can be replaced with a spring, an elastic member or any other suitable element or mechanical device attached, secured and/or connected in any suitable manner that applies a force that urges clamping member 50 toward front portion 46.

The components and elements of this invention can be constructed of wood, metal, plastic, graphite or any other suitable material or composite material. The shapes and sizes of the components can be varied to accommodate particular uses of the invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described can be varied considerably without departing from the basic principles of this invention.

I claim:

1. A martial arts apparatus for mounting a breaking board with respect to a structural support member, the apparatus comprising:

a backing frame adjustably mounted with respect to the structural support member, a back plate adjustably mounted with respect to said backing frame, a front plate adjustably mounted to rotate with respect to said back plate; and a pair of arms, each of said arms pivotally attached with respect to said front plate, each of said arms having a front portion and a rear portion, said front portion pivotally mounted with respect to said rear portion, a plurality of clamping members, each of said clamping members mechanically cooperating with a corresponding one of said front portions to clamp the breaking board between said clamping members and said front portions.

2. An apparatus according to claim 1 wherein the structural support member comprises an elongated upright member, said upright member has a plurality of spaced first holes, said backing frame has a plurality of spaced second holes, and a pin is mounted through one of said first holes and one of said second holes.

3. An apparatus according to claim 2 further comprising a base, and said upright member is secured to said base.

4. An apparatus according to claim 1 wherein said backing frame is adjustable in a generally vertical direction with respect to a ground surface.

5. An apparatus according to claim 1 further comprising a plurality of mounting brackets secured with respect to said back plate, each said mounting bracket having a first hole, said backing frame having a plurality of second holes, and a pin mounted within said first hole and one of said second holes.

6. An apparatus according to claim 5 wherein said mounting brackets are slidably adjustable with respect to said backing frame.

7. An apparatus according to claim 1 wherein said front plate is positioned approximately parallel to said back plate, a rod is secured with respect to said back plate, said front plate has a mounting hole, and said rod is mounted within said mounting hole.

8. An apparatus according to claim 7 wherein said rod is an externally threaded bolt.

9. An apparatus according to claim 1 wherein each of said arms pivot about a hinge attached to said front plate.

10. An apparatus according to claim 9 wherein said arms generally pivot in a first plane.

11. An apparatus according to claim 10 wherein said front portion and said rear portion generally pivot in a second plane, and said second plane is generally perpendicular to said first plane.

12. An apparatus according to claim 1 further comprising a plurality of hydraulic cylinders, each said hydraulic cylinder having one end portion attached with respect to one of said clamping members and another end portion attached with respect to a corresponding one of said front portions.

13. An apparatus according to claim 1 wherein in a clamped position of the breaking board said clamping members contact one face of the breaking board and said front portions contact another face of the breaking board.

14. An apparatus according to claim 1 wherein each of said clamping members comprises an angle bracket.

15. An apparatus according to claim 1 further comprising bias means for normally urging said arms away from each other.

16. A martial arts apparatus for mounting a breaking board with respect to a structural support member, the apparatus comprising:

a backing frame adjustably mounted with respect to the structural support member, a back plate adjustably mounted with respect to said backing frame, a front plate adjustably mounted to rotate with respect to said back plate; and a pair of arms, each of said arms pivotally attached with respect to said front plate, each of said arms having a front portion and a rear portion, said front portion pivotally mounted with respect to said rear portion, a plurality of clamping members, and means for clamping the breaking board between said clamping members and said front portions.

17. An apparatus according to claim 16 wherein said means comprise a plurality of hydraulic cylinders, each said hydraulic cylinder having one end portion attached to one of said clamping members and another end portion attached with respect to a corresponding one of said front portions.

* * * * *